US008184823B2

(12) United States Patent
Itabashi et al.

(10) Patent No.: US 8,184,823 B2
(45) Date of Patent: May 22, 2012

(54) HEADPHONE DEVICE, SOUND REPRODUCTION SYSTEM, AND SOUND REPRODUCTION METHOD

(75) Inventors: Tetsunori Itabashi, Kanagawa (JP); Kohei Asada, Kanagawa (JP)

(73) Assignee: Sony Corporation, Tokyo (JP)

( * ) Notice: Subject to any disclaimer, the term of this patent is extended or adjusted under 35 U.S.C. 154(b) by 1138 days.

(21) Appl. No.: 11/966,452

(22) Filed: Dec. 28, 2007

(65) Prior Publication Data

US 2008/0187148 A1 Aug. 7, 2008

(30) Foreign Application Priority Data

Feb. 5, 2007 (JP) ..... 2007-025918

(51) Int. Cl.
*H04R 1/10* (2006.01)

(52) U.S. Cl. ..... 381/74; 381/91; 381/92; 381/95

(58) Field of Classification Search ..... 381/74, 381/91–92, 95

See application file for complete search history.

(56) References Cited

U.S. PATENT DOCUMENTS 5,276,740 A 1/1994 Inanaga et al.
7,592,941 B2 * 9/2009 Ohkuri et al. ..... 341/155

FOREIGN PATENT DOCUMENTS

JP 3-96199 4/1991
JP 3-214892 9/1991
JP 5-316587 11/1993
JP 6-233388 8/1994
JP 6-261388 9/1994
JP 8-307986 11/1996
JP 9-140000 5/1997
JP 2000-181498 6/2000
JP 2004-361938 12/2004
JP 2006-303732 11/2006
WO WO 2004/016037 A1 2/2004

OTHER PUBLICATIONS

U.S. Appl. No. 11/936,894, filed Nov. 8, 2007, Asada, et al.
U.S. Appl. No. 11/865,419, filed Oct. 1, 2007, Asada, et al.
U.S. Appl. No. 11/865,354, filed Oct. 1, 2007, Asada.
U.S. Appl. No. 11/875,374, filed Oct. 19, 2007, Asada.
U.S. Appl. No. 11/936,882, filed Nov. 8, 2007, Asada, et al.
U.S. Appl. No. 11/936,876, filed Nov. 8, 2007, Asada, et al.
U.S. Appl. No. 11/952,468, filed Dec. 7, 2007, Asada, et al.
U.S. Appl. No. 12/015,824, filed Jan. 17, 2008, Asada, et al.
Office Action issued Sep. 13, 2011, in Japanese Patent Application No. 2007-025918.
Office Action issued Nov. 9, 2010 in Chinese Patent Application No. 200810006234.1 (with English translation).

* cited by examiner

*Primary Examiner* — Theresa T Doan
(74) *Attorney, Agent, or Firm* — Oblon, Spivak, McClelland, Maier & Neustadt, L.L.P.

(57) ABSTRACT

Disclosed herein is a headphone device, including: a sound pickup section configured to pick up an external sound; a directivity setting section configured to generate a directional pickup audio signal, which is an audio signal obtained by picking up the external sound with a desired directional characteristic, based on an audio signal outputted from the sound pickup section; a loudspeaker; an audio signal generation section configured to generate a cancellation-use audio signal for attenuating the directional pickup audio signal based on the directional pickup audio signal; and a driving signal generation section configured to generate a driving signal, which is an audio signal for driving the loudspeaker and includes at least the cancellation-use audio signal.

5 Claims, 12 Drawing Sheets

HEADPHONE DEVICE, SOUND REPRODUCTION SYSTEM, AND SOUND REPRODUCTION METHOD

CROSS REFERENCES TO RELATED APPLICATIONS

The present invention contains subject matter related to Japanese Patent Application JP 2007-025918, filed in the Japan Patent Office on Feb. 5, 2007, the entire contents of which being incorporated herein by reference.

BACKGROUND OF THE INVENTION

1. Field of the Invention

The present invention relates to a headphone device to be used by a user by wearing the headphone device on his or her head, for example, a sound reproduction system that includes such a headphone device and is used for reproducing a sound, and a sound reproduction method that is applied to the headphone device or the sound reproduction system.

2. Description of the Related Art

A so-called noise cancellation system is known that is implemented on a headphone device and used to cancel external noise that comes when a sound of content, such as a tune, is being reproduced by the headphone device. Such noise cancellation systems have been put to practical use. The noise cancellation systems are broadly classified into a feedback system and a feedforward system.

For example, Japanese Patent Laid-Open No. Hei 3-214892 (referred to as Patent Document 1 hereinafter) describes a structure of a feedback noise cancellation system in which noise inside a sound tube worn on an ear of a user is picked up by a microphone unit provided close to an earphone unit within the sound tube, a phase-inverted audio signal of the noise is generated, and this audio signal is outputted as sound via the earphone unit, so that the external noise is reduced.

Meanwhile, Japanese Patent Laid-Open No. Hei 3-96199 (referred to as Patent Document 2 hereinafter) describes a structure of a feedforward noise cancellation system in which, in essence, noise is picked up by a microphone attached to the exterior of a headphone device, a characteristic based on a desired transfer function is given to an audio signal of the noise, and a resultant audio signal is outputted from the headphone device.

SUMMARY OF THE INVENTION

Noise cancellation systems in known headphone devices have two microphones provided for left and right ears, and each of the microphones picks up noises coming from, if possible, all directions so that the noises coming from all directions can be cancelled. That is, the known noise cancellation systems are configured to cancel noises that come from all directions to a user who wears the headphone device.

Cancellation of the noises coming from all directions will result in a very desirable listening environment for simply listening to a reproduced sound of content. In this case, however, the user will not be able to hear a sound that comes from the side or from behind, i.e., from a blind spot for the user, for example. Therefore, when using the headphone outdoors at a place where traffic is heavy, for example, the user has to be more careful for the sake of safety.

Moreover, depending on the environment in which the user uses the headphone device, the user may desire to hear a voice of a person in front of the user while canceling noises coming from the other directions.

In other words, when using the noise cancellation system of the headphone device, the user may desire to prevent a sound coming from a specific direction from being cancelled, depending on the usage environment, purpose, or the like at the time. As such, the present invention has been devised to provide a noise cancellation system that satisfies such a demand.

According to one embodiment of the present invention, there is provided a headphone device including: a sound pickup section configured to pick up an external sound; a directivity setting section configured to generate a directional pickup audio signal, which is an audio signal obtained by picking up the external sound with a desired directional characteristic, based on an audio signal outputted from the sound pickup section; a loudspeaker; an audio signal generation section configured to generate a cancellation-use audio signal for attenuating the directional pickup audio signal based on the directional pickup audio signal; and a driving signal generation section configured to generate a driving signal, which is an audio signal for driving the loudspeaker and includes at least the cancellation-use audio signal.

According to another embodiment of the present invention, there is provided a headphone system including a headphone device and a signal processing device. The headphone device includes a sound pickup section configured to pick up an external sound, and a loudspeaker. The signal processing device includes: a directivity setting section configured to generate a directional pickup audio signal, which is an audio signal obtained by picking up the external sound with a desired directional characteristic, based on an audio signal outputted from the sound pickup section; an audio signal generation section configured to generate a cancellation-use audio signal for attenuating the directional pickup audio signal based on the directional pickup audio signal; and a driving signal generation section configured to generate a driving signal, which is an audio signal for driving the loudspeaker and includes at least the cancellation-use audio signal.

According to yet another embodiment of the present invention, there is provided a sound reproduction method including the steps of: a sound pickup section picking up an external sound and outputting an audio signal; generating a directional pickup audio signal, which is an audio signal obtained by picking up the external sound with a desired directional characteristic, based on the audio signal; generating a cancellation-use audio signal for attenuating the directional pickup audio signal based on the directional pickup audio signal; generating a driving signal, which is an audio signal for driving a loudspeaker and includes at least the cancellation-use audio signal; and outputting a sound based on the driving signal.

In the above-described embodiments, first, as the audio signal obtained by the sound pickup section provided for picking up an external sound, the audio signal obtained by picking up the external sound with desired directivity is obtained. That is, as a result, an audio signal (i.e., the directional pickup audio signal) equivalent to an audio signal that would be obtained by a sound pickup section in which the desired directivity is set picking up the external sound is obtained. Then, this directional pickup audio signal is used to generate the cancellation-use audio signal, which is an audio signal for allowing the external sound to be cancelled when a user who is wearing the headphone device listens to a reproduced sound, and this cancellation-use audio signal is outputted from the loudspeaker.

According to the above structure, instead of external sounds coming from all surrounding spaces, external sounds coming from a space corresponding to the set directivity are cancelled.

In accordance with the present invention, only an external sound coming from a space in a specific direction is cancelled when listening to a sound outputted via the headphone device. This results in satisfaction of a desire that only an external sound coming from a specific direction should not be cancelled when using the headphone device, for example.

DETAILED DESCRIPTION OF THE PREFERRED EMBODIMENTS

Hereinafter, preferred embodiments of the present invention will be described with reference to an exemplary case of headphone devices in which noise cancellation systems are implemented.

Before describing structures of the preferred embodiments, basic concepts of noise cancellation systems used in headphone devices will now be described below.

As basic systems of the noise cancellation systems used in the headphone devices, a system that performs servo control in accordance with a feedback system and a system that performs servo control in accordance with a feedforward system are known. First, the feedback system will now be described below with reference to FIG. 1.

Figure 1B:
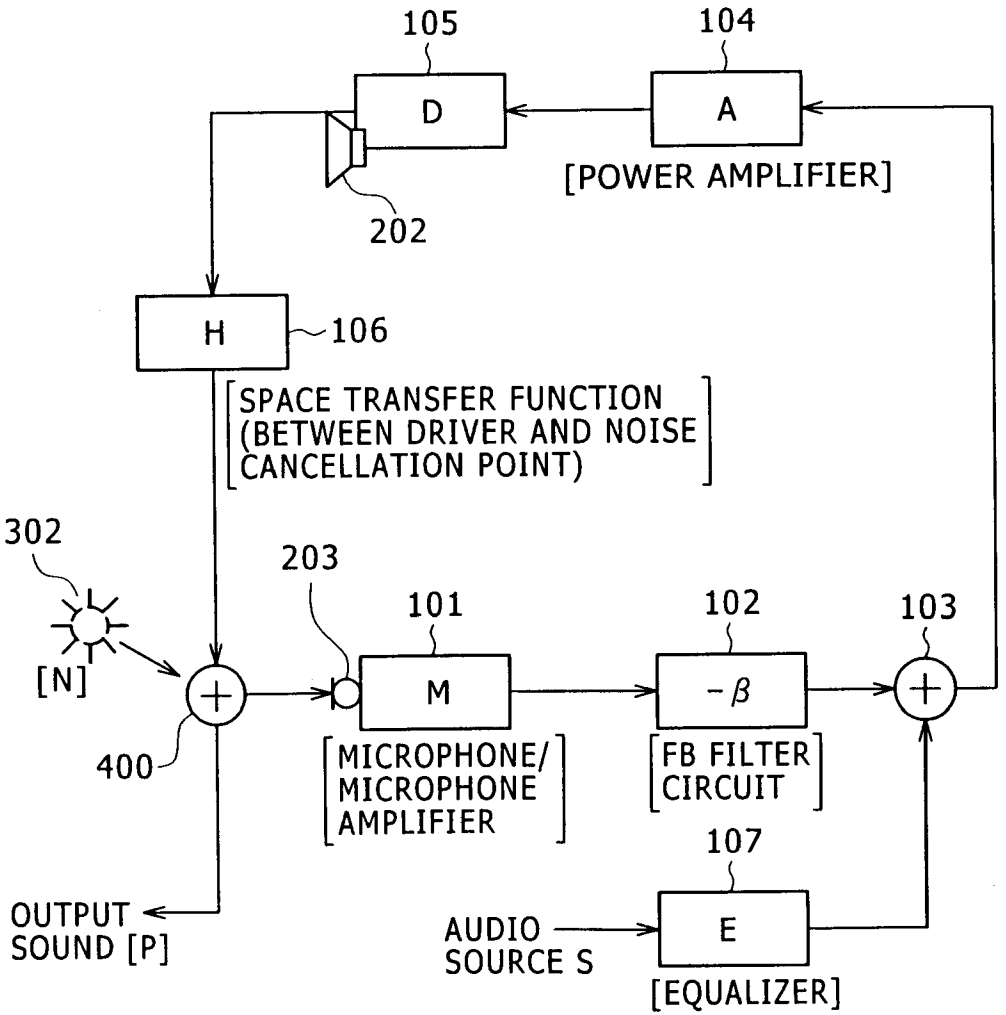
FIGS. 1A and 1B illustrate model examples of a noise cancellation system in a headphone device in accordance with a feedback system.
Figure 1A:
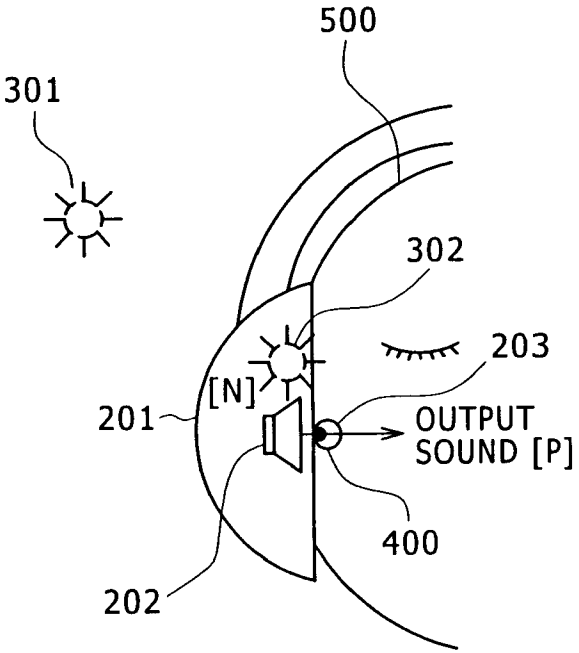

FIG. 1A is a schematic diagram of a model example of a noise cancellation system in accordance with the feedback system. FIG. 1A illustrates a right-ear side of a user who is wearing headphones, i.e., the side of an R-channel out of two (L (left) and R (right)) stereo channels.

Regarding a structure of the headphone device on the R-channel side, a driver 202 is provided, inside a housing section 201 corresponding to a right ear of a user 500 who is wearing the headphone device, at a location corresponding to the right ear. The driver 202 is equivalent to a so-called loudspeaker, and outputs (emits) a sound to a space as a result of being driven by an amplified output of an audio signal.

In addition, for the feedback system, a microphone 203 is provided at a location inside the housing section 201 and close to the right ear of the user 500. The microphone 203 thus provided picks up the sound outputted from the driver 202 and a sound that has come from an external noise source 301 and entered into the housing section 201, and is reaching the right ear, i.e., an in-housing noise 302 that is an external sound to be heard by the right ear. The in-housing noise 302 is caused, for example, by the sound coming from the noise source 301 intruding, as sound pressure, into the housing section 201 through a gap of an ear pad or the like, or by a housing of the headphone device vibrating as a result of receiving the sound pressure from the noise source 301 so that the sound pressure is transmitted into the inside of the housing section.

Then, from an audio signal obtained by the sound pickup by the microphone 203, a signal (i.e., an audio signal for cancellation) for canceling (attenuating or reducing) the in-housing noise 302, e.g., a signal having an inverse characteristic relative to an audio signal component of the external sound, is generated, and this signal is fed back so as to be combined with an audio signal (audio source) of a necessary sound for driving the driver 202. As a result, at a noise cancellation point 400, which is set at a location inside the housing section 201 and corresponding to the right ear, the sound outputted from the driver 202 and the external sound are combined to obtain a sound in which the external sound is cancelled, so that the resulting sound is heard by the right ear of the user. The above structure is also provided on an L-channel (left ear) side, so that a noise cancellation system used in a common dual (L and R) channel stereo headphone device is obtained.

FIG. 1B is a block diagram of a basic model structure example of the noise cancellation system in accordance with the feedback system. In FIG. 1B, as in FIG. 1A, only components corresponding to the R-channel (right ear) side are shown. Note that a similar system structure is provided on the L-channel (left ear) side as well. Blocks shown in this figure each represent a single specific transfer function corresponding to a specific circuit portion, circuit system, or the like in the noise cancellation system in accordance with the feedback system. These blocks will be referred to as "transfer function blocks" herein. A character written in each transfer function block represents a transfer function of that transfer function block. An audio signal (or sound) that passes through one of the transfer function blocks is given the transfer function written in that transfer function block.

First, the sound picked up by the microphone 203 provided inside the housing section 201 is obtained as an audio signal that has passed through a transfer function block 101 (whose transfer function is M) corresponding to the microphone 203 and a microphone amplifier that amplifies an electrical signal obtained by the microphone 203 and outputs the audio signal. The audio signal that has passed through the transfer function block 101 is inputted to a combiner 103 through a transfer function block 102 (whose transfer function is −β) corresponding to a feedback (FB) filter circuit. The FB filter circuit is a filter circuit having set therein a characteristic for generating the aforementioned cancellation-use audio signal from the audio signal obtained by sound pickup by the microphone 203. The transfer function of the FB filter circuit is denoted as −β.

It is assumed here that an audio signal S of the audio source, which is content such as a tune, is equalized by an equalizer, and that the audio signal S is inputted to the combiner 103 through a transfer function block 107 (whose transfer function is E) corresponding to the equalizer.

The combiner 103 combines (adds) the above two signals together. A resultant audio signal is amplified by a power amplifier and outputted to the driver 202 as a driving signal, so that the audio signal is outputted via the driver 202 as a sound. That is, the audio signal outputted from the combiner 103 passes through a transfer function block 104 (whose transfer function is A) corresponding to the power amplifier, and then passes through a transfer function block 105 (whose transfer function is D) corresponding to the driver 202, so that the sound is emitted to the space. The transfer function D of the driver 202 depends on a structure of the driver 202 and so on, for example.

The sound outputted from the driver 202 passes through a transfer function block 106 (whose transfer function is H) corresponding to a space path (space transfer function) from the driver 202 to the noise cancellation point 400 to reach the noise cancellation point 400, and is combined with the in-housing noise 302 at this point in space. As a result, in sound pressure P of an output sound that travels from the noise cancellation point 400 to reach the right ear, for example, the sound from the noise source 301 that has entered into the housing section 201 is cancelled.

In the model example of the noise cancellation system as illustrated in FIG. 1B, the sound pressure P of the output sound is given by expression 1 below, using the transfer functions M, −β, E, A, D, and H written in the transfer function blocks, on the assumption that the in-housing noise 302 is N and the audio signal of the audio source is S.

$$P = \frac{1}{1 + ADHM\beta}N + \frac{AHD}{1 + ADHM\beta}ES \qquad \text{[Expression 1]}$$

It is apparent from the above expression 1 that the in-housing noise 302, N, is attenuated by a coefficient 1/(1+ADHMβ). Note, however, that in order for the system as shown by expression 1 to operate stably without occurrence of oscillation in a frequency range of the noise to be reduced, expression 2 below has to be satisfied.

$$\left|\frac{1}{1 + ADHM\beta}\right| < 1 \qquad \text{[Expression 2]}$$

Generally, considering the fact that an absolute value of the product of the transfer functions in the noise cancellation system in accordance with the feedback system is expressed as 1<<|ADHMβ| and Nyquist stability determination in a classic control theory, expression 2 can be interpreted as follows.

Consider a system that is represented by −ADHMβ and which is obtained by cutting, at one point, a loop portion related to the in-housing noise 302, N, in the noise cancellation system as illustrated in FIG. 1B. This system will be referred to as an "open loop" herein. For example, this open loop can be formed when the above loop portion is cut at a point between the transfer function block 101 corresponding to the microphone and the microphone amplifier and the transfer function block 102 corresponding to the FB filter circuit.

Figure 2:
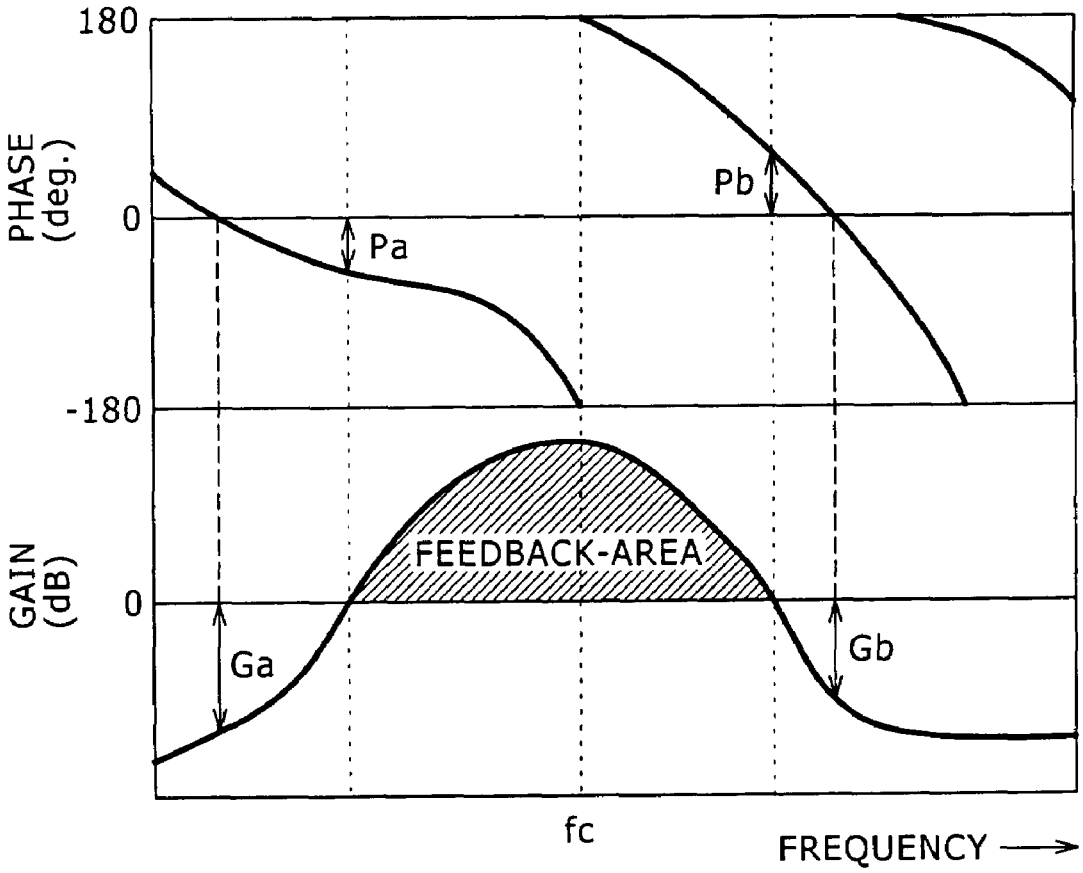
FIG. 2 is a Bode plot representing characteristics concerning the noise cancellation system as illustrated in FIGS. 1A and 1B.

This open loop has characteristics shown by a Bode plot of FIG. 2, for example. In this Bode plot, a horizontal axis represents frequency, whereas in a vertical axis, gain is shown in the lower half and phase is shown in the upper half.

In the case of this open loop, in order for expression 2 above to be satisfied based on the Nyquist stability determination, two conditions below have to be satisfied.

Condition 1: The gain should be less than 0 dB when a point of phase 0 deg. (0 degrees) is passed.

Condition 2: A point of phase 0 deg. should not be passed when the gain is equal to or greater than 0 dB.

When the two conditions 1 and 2 are not satisfied, the loop involves a positive feedback, resulting in occurrence of oscillation (howling). In FIG. 2, phase margins Pa and Pb corresponding to condition 1 above and gain margins Ga and Gb corresponding to condition 2 above are shown. If these margins are small, the probability of the occurrence of oscillation is increased depending on various differences between individual users who use the headphone device to which the noise cancellation system is applied, variations in how the headphone device is worn, and so on.

In FIG. 2, for example, when points of phase 0 deg. are passed, the gain is less than 0 dB, resulting in the gain margins Ga and Gb. In contrast, in the case where when a point of phase 0 deg. is passed, the gain is equal to or greater than 0 dB, resulting in absence of the gain margin Ga or Gb, or in the case where when a point of phase 0 deg. is passed, the gain is less than 0 dB but close to 0 dB, resulting in a small gain margin Ga or Gb, for example, oscillation occurs or the probability of the occurrence of oscillation is increased.

Similarly, in FIG. 2, when the gain is equal to or greater than 0 dB, a point of phase 0 deg. is not passed, resulting in the phase margins Pa and Pb. In contrast, in the case where when the gain is equal to or greater than 0 dB, a point of phase 0 deg. is passed, or in the case where when the gain is equal to or greater than 0 dB, the phase is close to 0 deg., resulting in a small phase margin Pa or Pb, for example, oscillation occurs or the probability of the occurrence of oscillation is increased.

Next, a case where, with the structure of the noise cancellation system in accordance with the feedback system as illustrated in FIG. 1B, a necessary sound is reproduced and outputted by the headphone device while the external sound (noise) is cancelled (reduced) will now be described below.

Here, the necessary sound is represented by the audio signal S of the audio source, which is the content such as the tune.

Note that the audio signal S is not limited to that of musical content or that of other similar content. In the case where the noise cancellation system is applied to a hearing aid or the like, for example, the audio signal S will be an audio signal obtained by sound pickup by a microphone (different from the microphone 203 provided in the noise cancellation system) provided on the exterior of a housing to pick up a necessary ambient sound. In the case where the noise cancellation system is applied to a so-called headset, the audio signal S will be an audio signal of, for example, a speech by the other party as received via communication such as telephone communication. In short, the audio signal S can correspond to any sounds that have to be reproduced and outputted depending on the applications of the headphone device and so on.

First, focus is placed on the audio signal S of the audio source in expression 1. It is assumed that the transfer function E corresponding to the equalizer is set to have a characteristic represented by expression 3 below.

$$E=(1+ADHM\beta) \quad \text{[Expression 3]}$$

When viewed in a frequency axis, the transfer characteristic E above is an inverse characteristic relative to the above open loop. Substituting the transfer function E as given by expression 3 into expression 1 gives expression 4, showing the sound pressure P of the output sound in the model of the noise cancellation system as illustrated in FIG. 1B.

$$P=\frac{1}{1+ADHM\beta}N+ADHS \quad \text{[Expression 4]}$$

Regarding the transfer functions A, D, and H in the term ADHS in expression 4, the transfer function A corresponds to the power amplifier, the transfer function D corresponds to the driver 202, and the transfer function H corresponds to the space transfer function of the path from the driver 202 to the noise cancellation point 400. Therefore, if the microphone 203 inside the housing section 201 is provided adjacent to the ear, regarding the audio signal S, an equivalent characteristic to that obtained by a common headphone that does not have a noise cancellation capability is obtained.

Next, a noise cancellation system in accordance with the feedforward system will now be described below.

Figure 3A:
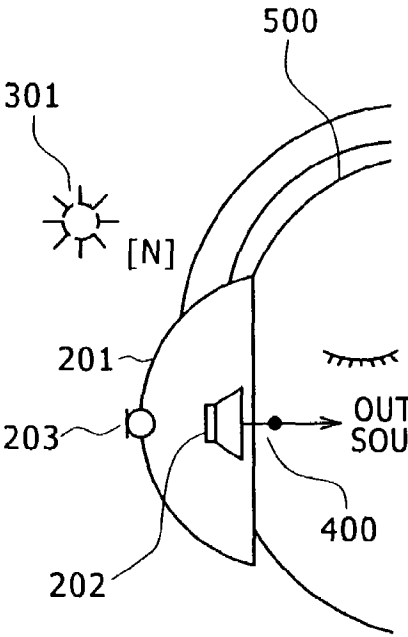
FIGS. 3A and 3B illustrate model examples of a noise cancellation system in a headphone device in accordance with a feedforward system.

FIG. 3A illustrates a model example of the noise cancellation system in accordance with the feedforward system. As with FIG. 1A, FIG. 3A shows only an R-channel side.

In the feedforward system, a microphone 203 is provided on the exterior of a housing section 201 so that a sound coming from a noise source 301 can be picked up. The external sound, i.e., the sound coming from the noise source 301, is picked up by the microphone 203 to obtain an audio signal, and this audio signal is subjected to an appropriate filtering process to generate a cancellation-use audio signal. Then, this cancellation-use audio signal is combined with an audio signal of a necessary sound. That is, the cancellation-use audio signal is combined with the audio signal of the necessary sound so as to involve the positive feedback.

Then, an audio signal obtained by combining the cancellation-use audio signal and the audio signal of the necessary sound is outputted via a driver 202, so that a sound in which the sound that has come from the noise source 301 and entered into the housing section 201 is cancelled is obtained and heard at a noise cancellation point 400.

Figure 3B:
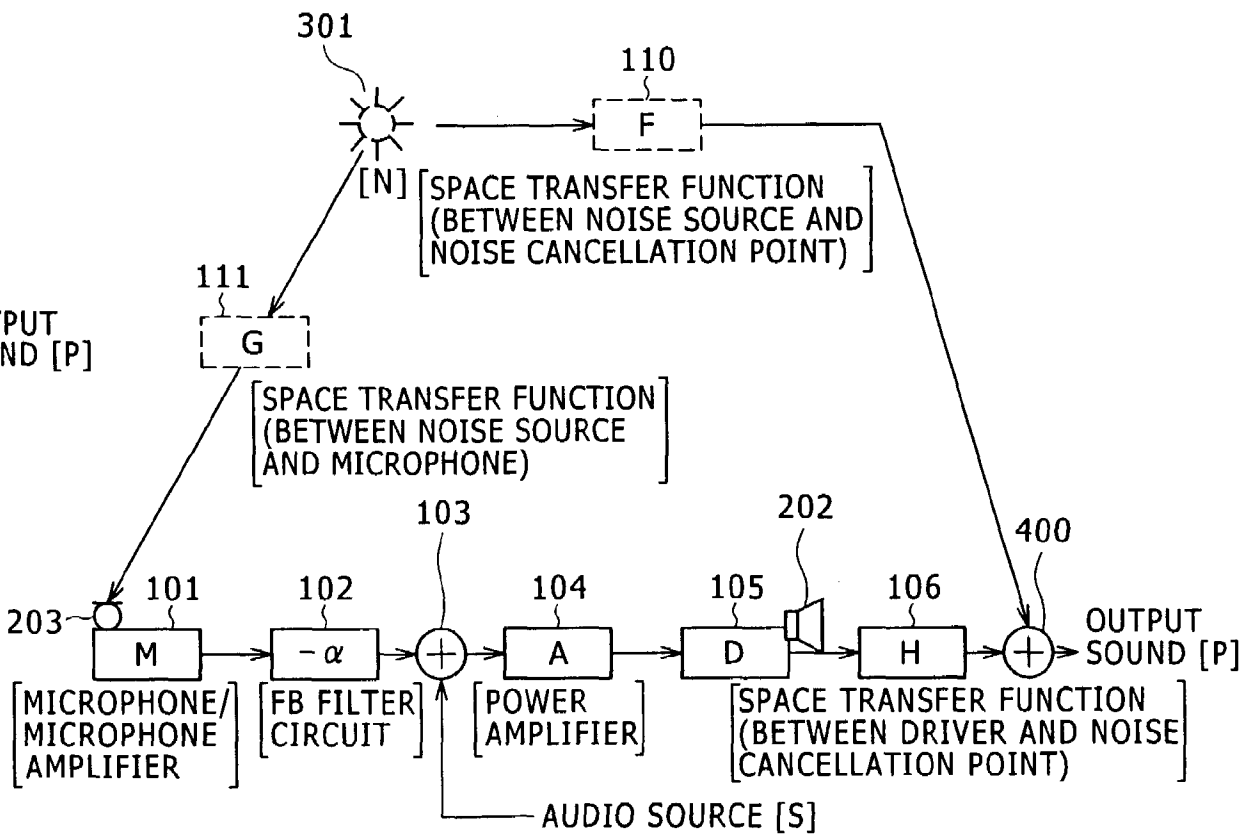

FIG. 3B illustrates a basic model structure example of the noise cancellation system in accordance with the feedforward system. In FIG. 3B, only components corresponding to one channel (the R-channel) are shown.

First, the sound picked up by the microphone 203 provided on the exterior of the housing section 201 is obtained as an audio signal that has passed through a transfer function block 101 having a transfer function M corresponding to the microphone 203 and a microphone amplifier.

Next, the audio signal that has passed through the above transfer function block 101 is inputted to a combiner 103 through a transfer function block 102 (whose transfer function is $-\alpha$) corresponding to a feedforward (FF) filter circuit. The FF filter circuit 102 is a filter circuit having set therein a characteristic for generating the aforementioned cancellation-use audio signal from the audio signal obtained by the sound pickup by the microphone 203. The transfer function of the FF filter circuit 102 is denoted as $-\alpha$.

An audio signal S of an audio source is directly inputted to the combiner 103.

The combiner 103 combines the above two audio signals, and a resultant audio signal is amplified by a power amplifier and outputted as a driving signal to the driver 202, so that a corresponding sound is outputted from the driver 202. That is, in this case also, the audio signal outputted from the combiner 103 passes through a transfer function block 104 (whose transfer function is A) corresponding to the power amplifier, and further passes through a transfer function block 105 (whose transfer function is D) corresponding to the driver 202, so that the corresponding sound is emitted to a space.

Then, the sound outputted from the driver 202 passes through a transfer function block 106 (whose transfer function is H) corresponding to a space path (space transfer function) from the driver 202 to the noise cancellation point 400 to reach the noise cancellation point 400, and is combined with an in-housing noise 302 at this point in space.

As shown as a transfer function block 110, the sound that has been emitted from the noise source 301, entered into the housing section 201, and reached the noise cancellation point 400 is given a transfer function (a space transfer function F) corresponding to a path from the noise source 301 to the noise cancellation point 400. Meanwhile, the external sound, i.e., the sound coming from the noise source 301, is picked up by the microphone 203. As shown as a transfer function block 111, before reaching the microphone 203, the sound (noise) emitted from the noise source 301 is given a transfer function (a space transfer function G) corresponding to a path from the noise source 301 to the microphone 203. In the FF filter circuit corresponding to the transfer function block 102, the transfer function $-\alpha$ is set considering the above space transfer functions F and G as well.

Thus, in sound pressure P of an output sound that travels from the noise cancellation point 400 to reach the right ear, for example, the sound that has come from the noise source 301 and entered into the housing section 201 is cancelled.

In the model example of the noise cancellation system in accordance with the feedforward system as illustrated in FIG. 3B, the sound pressure P of the output sound is given by expression 5 below, using the transfer functions M, $-\alpha$, G, F, A, D, and H written in the transfer function blocks, on the assumption that the noise emitted from the noise source 301 is N and the audio signal of the audio source is S.

$$P=-GADHM\alpha N+FN+ADHS \quad \text{[Expression 5]}$$

Ideally, the transfer function F of the path from the noise source 301 to the noise cancellation point 400 is given by expression 6 below.

$$F=GADHM\alpha \quad \text{[Expression 6]}$$

Substituting expression 6 into expression 5 results in cancellation of the first and second terms on the right-hand side of expression 5. As a result, the sound pressure P of the output sound is given by expression 7 below.

$$P=ADHS \quad \text{[Expression 7]}$$

This shows that the sound coming from the noise source 301 is cancelled, so that only a sound corresponding to the audio signal of the audio source is obtained. That is, in theory, the sound in which the noise is cancelled is heard by the right ear of the user. In practice, however, it is difficult to construct such a perfect FF filter circuit as to give the transfer function that completely satisfies expression 6. Moreover, differences in the shape of ears and how to wear the headphone device are relatively large between different individuals, and it is known that changes in relationships between a location at which the noise arises and a location of the microphone affect the effect of noise reduction, particularly with respect to mid and high frequency ranges. Accordingly, active noise reduction processing is often omitted concerning the mid and high frequency ranges, while, primarily, passive sound insulation is performed depending on the structure of the housing of the headphone device and so on.

Note that expression 6 means that the transfer function of the path from the noise source 301 to the ear is imitated by an electric circuit containing the transfer function $-\alpha$.

In the noise cancellation system in accordance with the feedforward system as illustrated in FIG. 3A, the microphone 203 is provided on the exterior of the housing. Therefore, unlike in the noise cancellation system in accordance with the feedback system as illustrated in FIG. 1A, the noise cancellation point 400 can be set arbitrarily inside the housing section 201 in accordance with the location of the ear of the user. In common cases, however, the transfer function $-\alpha$ is fixed, and in a design stage, the transfer function $-\alpha$ is designed for a certain target characteristic. Meanwhile, the size of ears and so on vary from user to user. Therefore, there is a possibility that a sufficient noise cancellation effect is not obtained, or that a noise component is not added in opposite phase, resulting in a phenomenon such as occurrence of a strange sound.

As such, there is a general understanding that, in the case of the feedforward system, oscillation occurs with a low probability, resulting in a high stability, but it is difficult to achieve sufficient noise reduction. On the other hand, in the case of the feedback system, large noise reduction is expected while care should be taken about system stability. Thus, the feedback system and the feedforward system have different features.

Next, a noise cancellation system in a headphone device in accordance with the present embodiment will now be described below.

When an attempt is made to actually construct a noise cancellation system in a headphone device, for example, the most normal way to achieve desired acoustic effects is to regard external sounds coming from all directions as noise and attempt to cancel them all. This is because sounds to be listened to via headphone devices are generally those of content such as a tune, and cancellation of all unwanted sounds coming from the outside, regardless of the direction from which they come, is desirable for listening to the sounds of the content.

In the case of the feedback system, for example, such a noise cancellation system can be easily constructed by simply following the model example of FIGS. 1A and 1B. In the case of the feedforward system, such a noise cancellation system can be constructed in accordance with the model example of FIGS. 3A and 3B while an omnidirectional microphone is adopted as the single microphone 203 so that ambient sounds coming from, if possible, all directions can be picked up. In such a manner, a noise cancellation system that attempts to cancel the external sounds coming from all directions can be obtained. For example, noise cancellation systems in known headphone devices have such a structure.

As noted previously, however, depending on the usage environment of the headphone device and so on, it may be necessary or desirable that external sounds coming from a specific direction (location) to the headphone device be not cancelled, instead of the external sounds coming from all directions being cancelled as noise.

As such, the noise cancellation system used in the headphone device in accordance with the present embodiment is so configured that external sounds coming from a specific direction (location) are not cancelled. This point will be described below.

The noise cancellation system in accordance with the present embodiment, which does not cancel the external sounds coming from the specific direction (location), adopts the feedforward system. As is apparent from FIG. 3A, in the feedforward system, the microphone 203 for picking up the external sounds (coming from the noise source) to be cancelled is provided on the exterior of the housing section 201. In the present embodiment, as will be understood by the following description, a beamforming technique using a so-called microphone array is adopted to pick up the external sounds coming from the noise source. Therefore, a plurality of microphones (i.e., the microphone array) have to be provided at different locations to pick up the external sounds. Accordingly, the feedforward system is suitable for this noise cancellation system.

Here, principles of the beamforming using the microphone array will now be described below.

Figure 4:
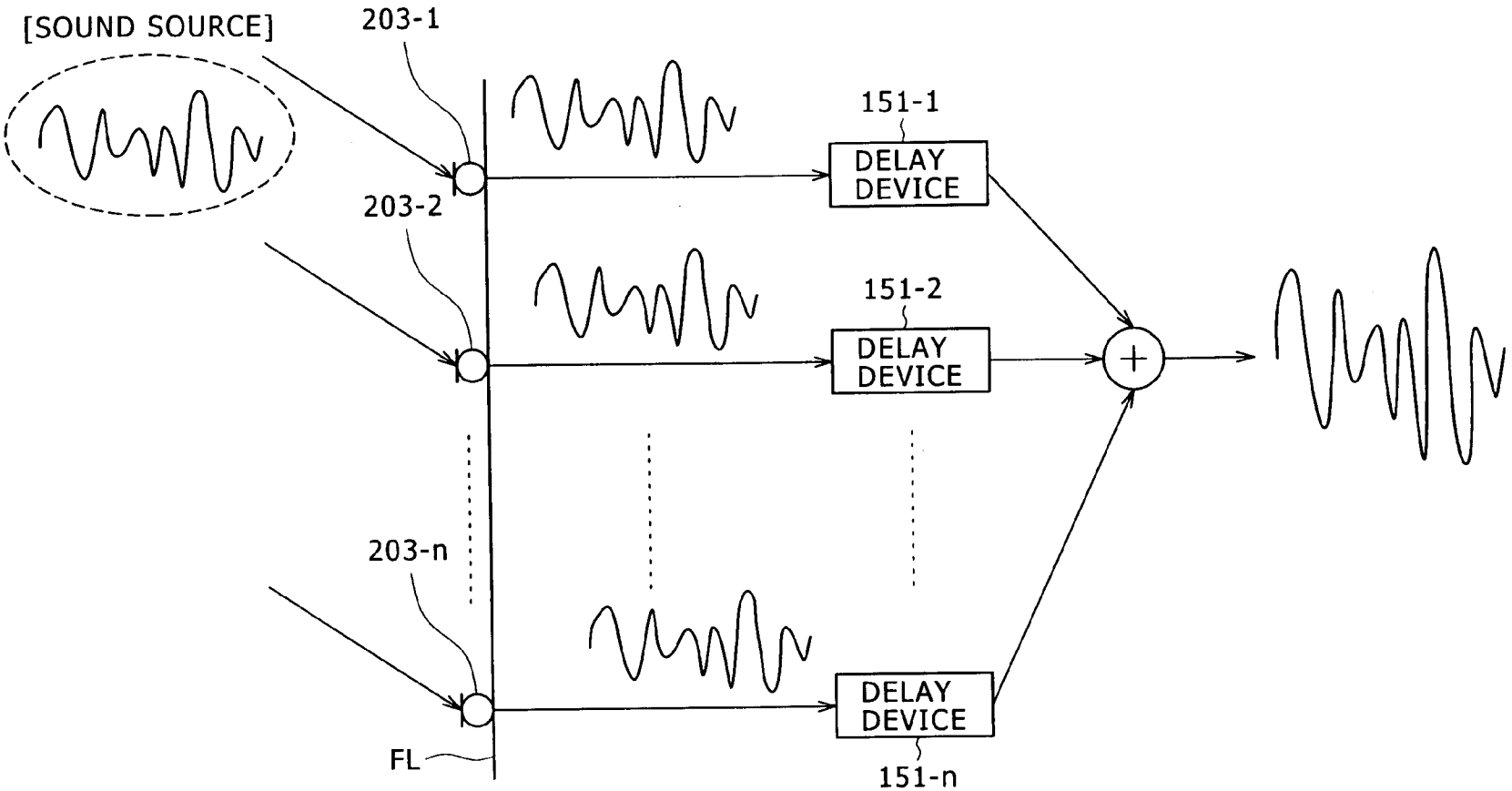
FIG. 4 illustrates principles of beamforming using a microphone array.

Referring to FIG. 4, suppose that microphones 203 (203-1 to **203-*n*) are arranged at regular intervals on a straight line FL, and that a sound is emitted from a sound source at a certain location away from this straight line FL. It is assumed here that all the microphones 203 (203-1 to 203-*n*) have the same characteristics in terms of directivity, sensitivity, and so on. It is assumed that all the microphones 203 (203-1 to 203-*n***) are omnidirectional.

In this case, the distance from the sound source to each of the microphones 203-1 to **203-*n* is different. For example, referring to FIG. 5, a difference in distance from the sound source between a microphone 203 at a location X0 and a microphone 203 at a location Xn is denoted as $\Delta dn$. In accordance with this difference, the microphones 203** pick up the same sound wave coming from the sound source at different times.

Suppose that the distance from the location of the sound source to each of the microphones 203 is known. Then, a difference in time necessary for the sound coming from the sound source to reach the microphone 203 between each pair of microphones 203 can be uniquely determined based on a difference in distance from the sound source between the pair of microphones 203.

Thus, as illustrated in FIG. 4, delay devices 151 (151-1 to **151-*n*) are provided for delaying audio signals obtained by the microphones 203 (203-1 to 203-*n*) arranged on the straight line FL by picking up the sound coming from the sound source. In these delay devices 151-1 to 151-*n*, appropriate delay times are set for compensating the differences in time necessary for the sound coming from the sound source to reach the microphones 203. As a result, the audio signals obtained by sound pickup by the microphones 203-1 to 203-*n* are caused to coincide with one another in a time axis (in phase) regarding signal components corresponding to the sound coming from the location of the sound source. Audio signals outputted from these delay devices 151-1 to 151-*n* are combined (added) together by a combiner 152**.

Regarding an audio signal outputted from the combiner 152, a signal component corresponding to the sound coming from the location of the above sound source is emphasized because it is a combination of the signal components identical in time axis (phase) and thus has an increased amplitude, whereas the remaining signal components corresponding to sounds coming from other sound sources are not emphasized because signal components corresponding to those sounds do not coincide but vary in time axis (phase) before entering the combiner 152. In other words, regarding the audio signal outputted from the combiner 152, only the component corresponding to the sound coming from the location of the specific sound source is emphasized, while the remaining components are relatively attenuated.

That is, according to the structure as illustrated in FIG. 4, the sounds are picked up by the plurality of microphones to obtain the audio signals, and these audio signals are combined together after being delayed by the appropriate delay times determined in accordance with the location of the specific sound source. Thus, the resulting audio signal is equivalent to an audio signal that would be obtained by picking up only the sound coming from the location of the specific sound source with high sensitivity. The above is the basic principles of the beamforming using the microphone array.

Figure 5:
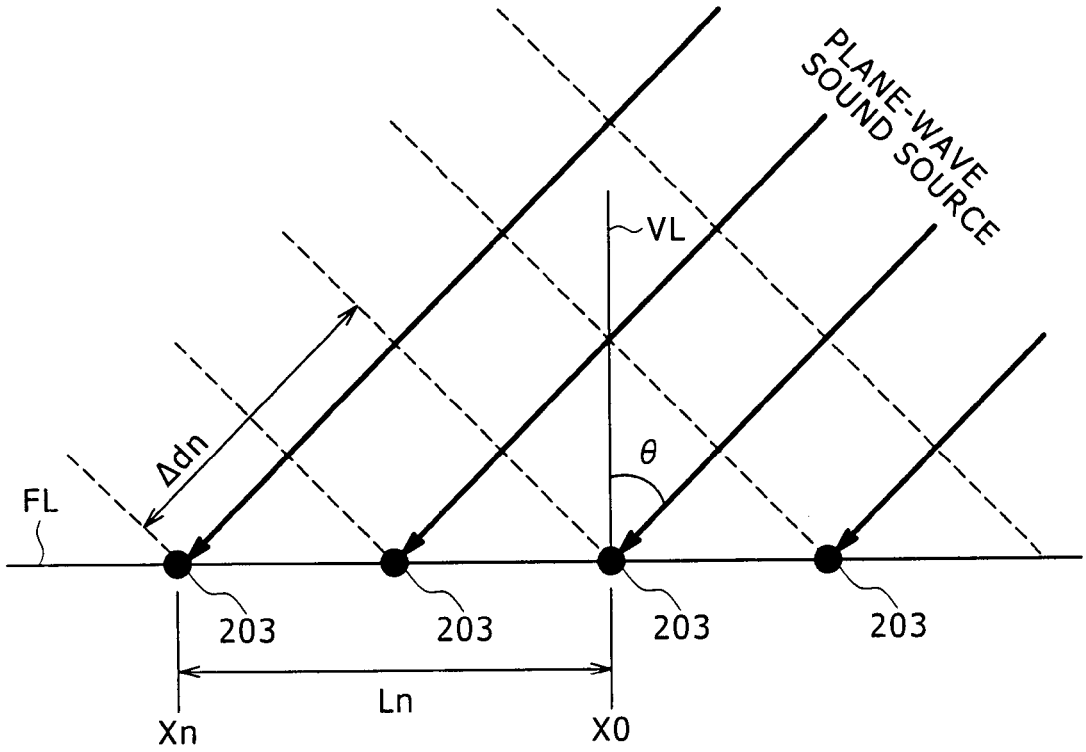
FIG. 5 illustrates model examples used for calculation for beamforming using the microphone array on the assumption that a sound comes in the form of plane waves.

Referring to FIG. 5, suppose that the plurality of microphones 203 are arranged at regular intervals on the straight line FL, and that a sound emitted at a location of a certain sound source is propagating in the form of plane waves. Then, assuming that a distance from a reference microphone location X0 to a microphone location Xn, which is a certain distance away from the reference microphone location X0, is Ln, a difference Δdn between a distance from the location of the sound source to the reference microphone location X0 and a distance from the location of the sound source to the microphone location Xn is given by expression 8 below.

$$\Delta dn = \mathrm{Ln} \cdot \sin\theta \qquad \text{[Expression 8]}$$

Referring to FIG. 5, in expression 8, θ denotes an angle between a straight line VL perpendicular to the straight line FL and a line of the direction of travel of the sound wave coming from the sound source. Next, in connection with the above difference Δdn in distance, a difference Δtn between a time necessary for arrival of the sound wave at the microphone location X0 and a time necessary for arrival of the sound wave at the microphone location Xn is given by expression 9 below, using the difference Δdn in distance and assuming that the speed of sound is denoted as c.

$$\Delta tn = \Delta dn / c \qquad \text{[Expression 9]}$$

In the delay devices 151-1 to **151-*n* as illustrated in FIG. 4, the respective delay times are set based on the difference Δtn in time necessary for arrival obtained in such a manner. An output from the combiner 152 obtained by combining outputs from the delay devices 151-1 to 151-*n*** is given by expression 10 below.

$$y(t) = \Sigma Xn(t - \Delta tn) \qquad \text{[Expression 10]}$$

Figure 6:
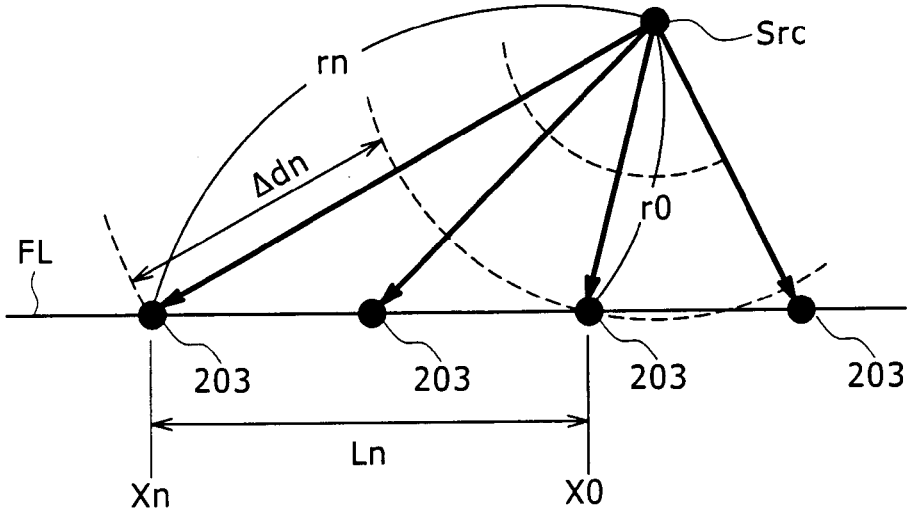
FIG. 6 illustrates a model example used for calculation for beamforming using the microphone array on the assumption that a sound source is a point sound source.

In the case of a model as illustrated in FIG. 6, in which a sound source Src is a point (i.e., a point sound source) and a sound wave radiates from this sound source, beamforming using a microphone array can be described as follows.

First, suppose that a distance between a reference microphone location X0 and a microphone location Xn, which is a certain distance away from the reference microphone location X0, is Ln. In the case of the point sound source as illustrated in FIG. 6, a distance from the sound source Src to each of the microphones can be handled as a radius of a circle whose center is the sound source Src and which passes through the location of the microphone. Therefore, assuming that a distance from the sound source Src to the microphone at the reference microphone location X0 is r0, and that a distance from the sound source Src to the microphone at the microphone location Xn is rn, a difference Δdn between the distance from the location of the sound source Src to the reference microphone location X0 and the distance from the location of the sound source to the microphone location Xn is given by expression 11 below.

$$\Delta dn = rn - r0 \qquad \text{[Expression 11]}$$

A difference Δtn between a time necessary for arrival of the sound wave at the microphone location X0 and a time necessary for arrival of the sound wave at the microphone location Xn is given by expression 9, but in this case, a value of Δdn obtained by expression 11 above is substituted into expression 9. Then, the output from the combiner 152 obtained by combining the outputs from the delay devices 151-1 to **151-*n*** is given by expression 10.

Figure 7:
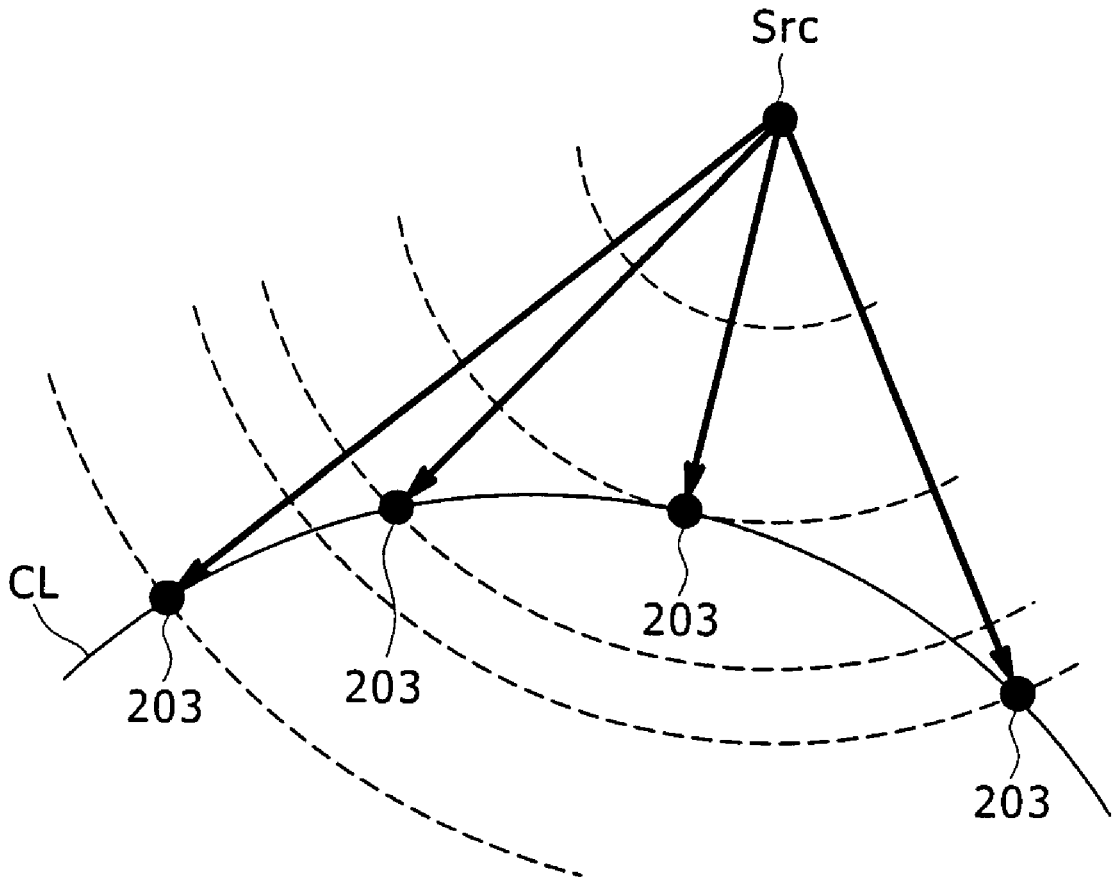
FIG. 7 illustrates a model example of beamforming using the microphone array on the assumption that microphones are arranged on a curve.

FIGS. 4, 5, and 6 described above assume the model in which the microphones 203 are arranged at regular intervals on the single straight line. However, as long as the locations at which the microphones 203 are arranged are fixed and known, the distance from the location of the specific sound source to each of the microphones can be determined uniquely, and therefore, it is also possible to determine the difference Δdn in distance and the difference Δtn in time necessary for arrival between each pair of microphones. Therefore, even in a model in which the microphones 203 are arranged on a curve CL as illustrated in FIG. 7, for example, the difference Δdn in distance and the difference Δtn in time necessary for arrival between each pair of microphones can be determined properly to achieve beamforming.

Figure 8:
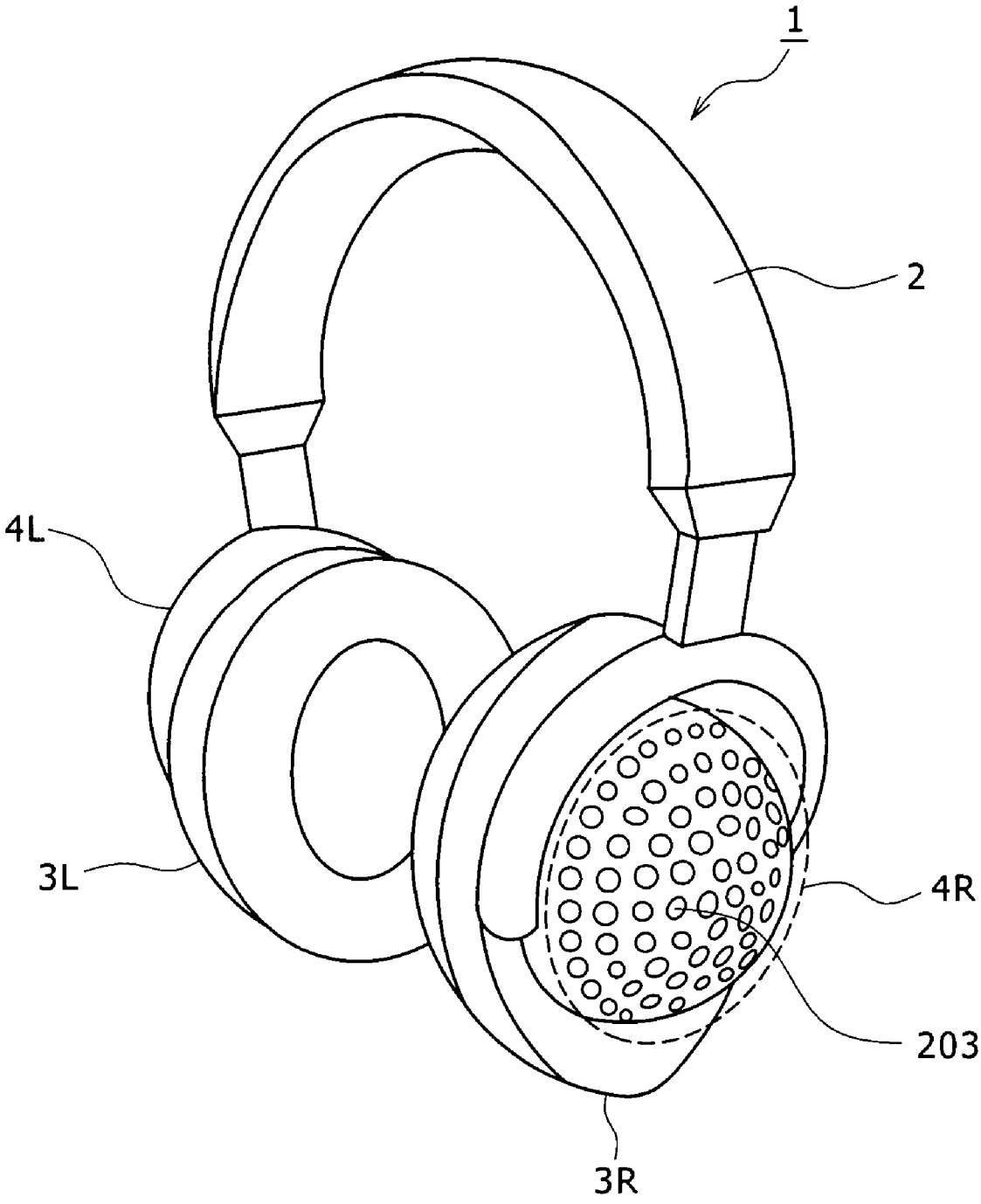
FIG. 8 illustrates an exemplary structure of a headphone device in accordance with one embodiment of the present invention.

Extending the above notion still further, not only in a two-dimensional arrangement in which the microphones are arranged on a single line but also in a three-dimensional arrangement in which the microphones are arranged on a curve or the like, the difference Δdn in distance and the difference Δtn in time necessary for arrival between each pair of microphones can be determined properly as long as the location of each of the microphones is known, and therefore beamforming can be achieved. Therefore, when actually implementing beamforming using the microphone array for the noise cancellation system in the headphone device, it is conceivable to provide the microphones 203 in a headphone device 1 in a manner as illustrated in FIG. 8, for example. The headphone device as illustrated in FIG. 8 can be used in the present embodiment.

The headphone device 1 as illustrated in FIG. 8 is of a so-called overhead band type, and at both ends of a headband 2 are attached a right housing section 3R and a left housing section 3L. The user places the headband 2 on his or her head such that pad sections inside the right housing section 3R and the left housing section 3L are applied to his or her right and left ears, respectively.

As depicted as a right microphone array section 4R, for example, a predetermined number of microphones 203 are provided on an outside part of the right housing section 3R such that the microphones 203 are arranged in accordance with a predetermined pattern. Similarly, a left microphone array section 4L composed of microphones 203 arranged in a similar manner is provided on the left housing section 3L.

In the model as illustrated in FIG. 4, the delay devices 151-1 to **151-*n* are provided for the respective microphones 203-1 to 203-*n* to achieve beamforming. However, this model is designed for the explanation of the principles. In practice, a structure as illustrated in FIG. 9** is adopted, for example.

Figure 9:
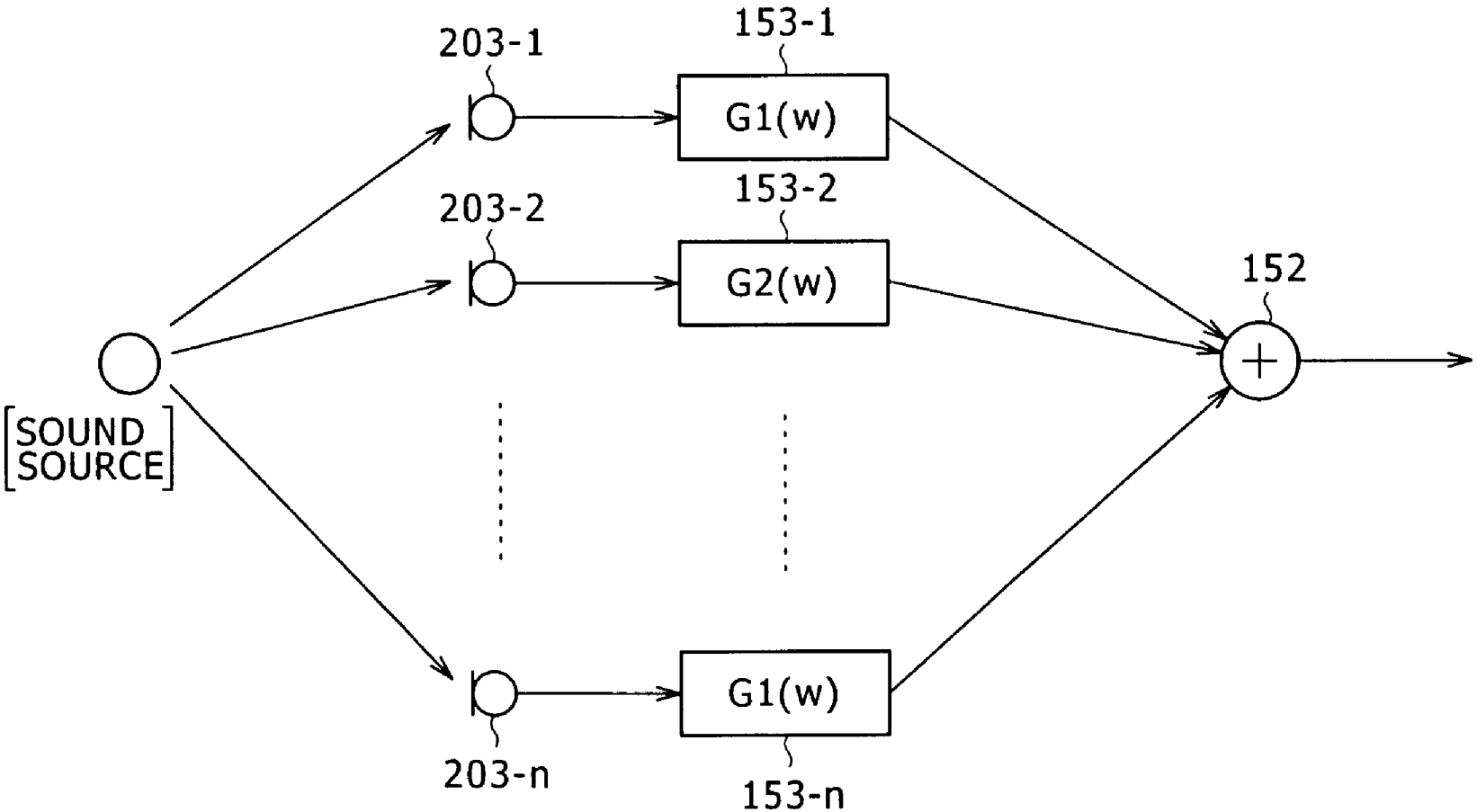
FIG. 9 illustrates an exemplary basic system structure for actually realizing beamforming using the microphone array.

In FIG. 9, in place of the delay devices 151-1 to **151-*n* illustrated in FIG. 4, filter circuits 153-1 to 153-*n* are provided. These filter circuits 153-1 to 153-*n* have transfer characteristics denoted as G1**(*w*) to Gn(w), respectively.

It should be noted that the beamforming technique described above has directional characteristics for identifying not only a direction but also a location in space. In other words, the beamforming technique is able to identify directional characteristics composed of a combination of directional and distance elements. Therefore, in the case where there are two sound sources located in the same direction but placed at different locations, for example, the beamforming is able to identify one of the two sound sources and emphasize only a sound coming from the identified sound source.

In the case of two-dimensional microphone arrays as illustrated in FIGS. 5, 6, and 7, for example, a minimum of two microphones are necessary to identify a location in space. In the case of three-dimensional microphone arrays as illustrated in FIG. 8, a minimum of three microphones are necessary to identify a location in space. The precision of the identification of the location in space increases as the number of microphones in a unit area increases, for example.

Figure 10:
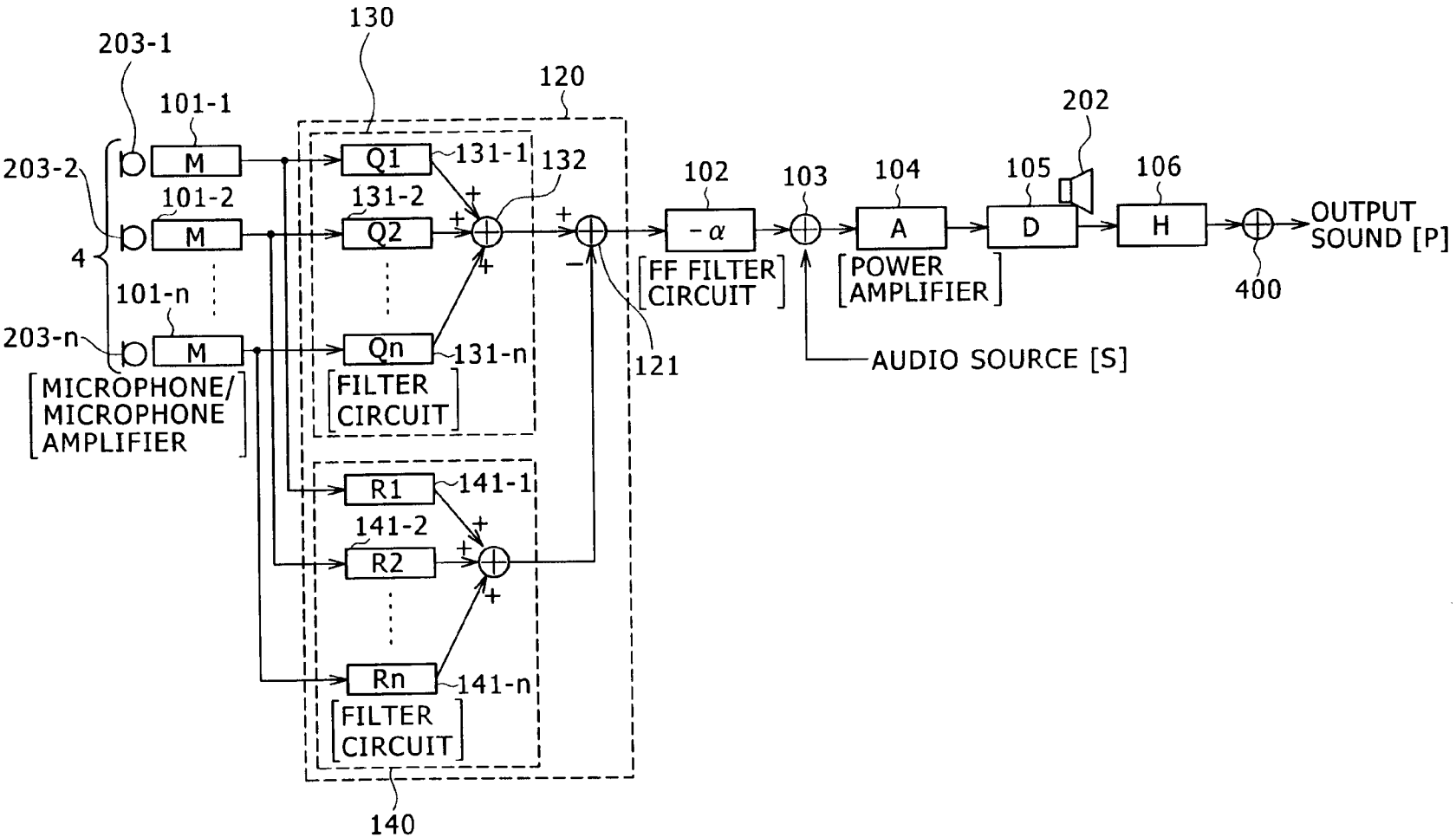
FIG. 10 illustrates an exemplary structure of a noise cancellation system in a headphone device in accordance with one embodiment of the present invention.

Next, a specific example of the structure of the noise cancellation system in the headphone device in accordance with the present embodiment will now be described below with reference to FIG. 10. In the present embodiment, the beamforming using the above microphone array is used to pick up unwanted sound components. In FIG. 10, components having their counterparts in FIG. 3B are assigned the same reference numerals as those of their counterparts in FIG. 3B, and descriptions thereof will be omitted here. As with FIG. 3B, the components illustrated in FIG. 10 correspond to one of the two (L and R stereo) channels.

As noted previously, the noise cancellation system in accordance with the present embodiment is based on the feedforward system in which the microphones used to pick up the unwanted sound components are provided on the exterior of the housing section. For example, as is apparent from comparing FIG. 10 with FIG. 3B, the noise cancellation system in accordance with the present embodiment as illustrated in FIG. 10 has the same structure as that of FIG. 3B in the FF filter circuit corresponding to the transfer function block 102 and subsequent stages.

As illustrated in FIG. 10, in the present embodiment, a predetermined number (more than one) of microphones 203-1 to **203-*n* are provided to pick up the unwanted sound components considered as noise. Note that these microphones 203-1 to 203-*n* form the microphone array section 4 (4R or 4L) as described above with reference to FIG. 8, for example. These microphones 203-1 to 203-*n* have the same characteristics. It is assumed here that the microphones 203-1 to 203-*n*** are omnidirectional.

Signals obtained by sound pickup by the microphones 203-1 to **203-*n* are amplified by their respective microphone amplifiers having the same characteristics, and resultant audio signals are outputted. In other words, the external sound is captured as n audio signals so as to pass through the microphones 203-1 to 203-*n* and transfer function blocks 101-1 to 101-*n*, which have a transfer function M and correspond in number to the microphone amplifiers corresponding to the microphones. The n audio signals thus obtained are inputted to a beamforming processing section 120**.

The beamforming processing section 120 in this case includes a cancellation filter section 130, an emphasis filter section 140, and a combiner 121. The combiner 121 performs addition or subtraction concerning audio signals outputted from these filter sections.

The cancellation filter section 130 includes filter circuits 131-1 to **131-*n* and a combiner 132. The audio signals outputted from the transfer function blocks 101-1 to 101-*n* are inputted to the filter circuits 131-1 to 131-*n*, respectively. The combiner 132 combines (adds) outputs from the filter circuits 131-1 to 131-*n*** together.

The filter circuits 131-1 to **131-*n* have set therein filter characteristics denoted as Q1 to Qn, respectively. The filter circuits 131-1 to 131-*n* have functions equivalent to those of the filter circuits 153-1 to 153-*n* as illustrated in FIG. 9. That is, in the audio signals that have passed through the filter circuits 131-1 to 131-*n*, signal components corresponding to a sound that came from a specific location (which is determined based on a specific direction and distance relative to the microphone array section 4) in space and which is to be cancelled have been caused to coincide in time axis (phase). The aforementioned filter characteristics Q1 to Qn are so set as to achieve such a result. Then, as a result of the combination (addition) by the combiner 132 of the outputs from the filter circuits 131-1 to 131-*n*, an audio signal is obtained in which only the signal components corresponding to the sound that came from the above location in space and which is to be cancelled are emphasized, as is the case with the output from the combiner 152 in FIG. 9**.

The emphasis filter section 140 includes filter circuits 141-1 to **141-*n* and a combiner 142. The audio signals outputted from the transfer function blocks 101-1 to 101-*n* are inputted to the filter circuits 141-1 to 141-*n*, respectively. The combiner 142** combines (adds) outputs from these filter circuits together.

These filter circuits 141-1 to **141-*n* have set therein predetermined filter characteristics R1 to Rn, respectively, so that, in audio signals outputted from the filter circuits 141-1 to 141-*n*, signal components corresponding to a sound that came from a specific location in space are caused to coincide in time axis. As a result of these audio signals being combined (added) together by the combiner 142**, an audio signal is obtained in which only the signal components corresponding to the sound that came from the above specific location in space are emphasized. Note, however, that this specific location in space does not correspond to the sound source of the sound to be cancelled but a sound source of a sound that should be heard emphatically.

Then, in the beamforming processing section 120, the combiner 121 combines the audio signal outputted from the combiner 132 in the cancellation filter section 130 and the audio signal outputted from the combiner 142 in the emphasis filter section 140 such that the former audio signal is added and the latter audio signal is subtracted, and a resultant audio signal is inputted to an FF filter circuit corresponding to the transfer function block 102 in the subsequent stage.

In the FF filter circuit in this case, a passing characteristic (transfer function $-\alpha$) is set so that an intruding sound (i.e., a sound that intruded from the outside) corresponding to the inputted audio signal will be cancelled at the noise cancellation point 400. Therefore, at the noise cancellation point 400, an intruding sound corresponding to the audio signal outputted from the cancellation filter section 130 is cancelled first. Conversely, an intruding sound corresponding to the audio signal outputted from the emphasis filter section 140 is combined with (added to) a reproduced sound at the noise cancellation point 400, and therefore, sound pressure thereof is increased, resulting in emphasized sound.

In the above-described manner, the structure of the present embodiment as illustrated in FIG. 10 results in a noise cancellation system in which the sound coming from a beamforming location set for the cancellation filter section 130 is cancelled, while the sound coming from a beamforming location set for the emphasis filter section 140 is emphatically heard.

As noted previously, the present embodiment aims "to prevent the external sound coming from the location (direction) of a specific sound source to the headphone device from being cancelled". Therefore, the emphasis filter section 140 within the beamforming processing section 120 as illustrated in FIG. 10 is not essential to the present embodiment. Even if the beamforming processing section 120 includes only the cancellation filter section 130, the above aim is achieved.

However, in the case where the beamforming processing section 120 additionally includes the emphasis filter section 140 as illustrated in FIG. 10, the external sound that has to be heard (i.e., should not be cancelled) becomes more audible, and it is possible to set (pinpoint) the location of the sound source of the external sound that has to be heard with great precision.

Next, an exemplary structure in accordance with another embodiment, which is an improvement from the structure as illustrated in FIG. 10, will now be described below.

For example, in the above-described embodiment as illustrated in FIG. 10, the location of the sound source of the sound to be cancelled and the location of the sound source of the sound to be emphasized as set in the beamforming processing section 120, i.e., the filter characteristics of the filter circuits 131-1 to **131-*n* and the filter circuits 141-1 to 141-*n***, can be considered fixed. However, it is conceivable that the location of the sound source of the sound to be cancelled and the location of the sound source of the sound to be emphasized may be set variably by a user operation or in accordance with conditions of ambient sounds, for example. The other embodiment described below has a structure for achieving this.

Figure 11:
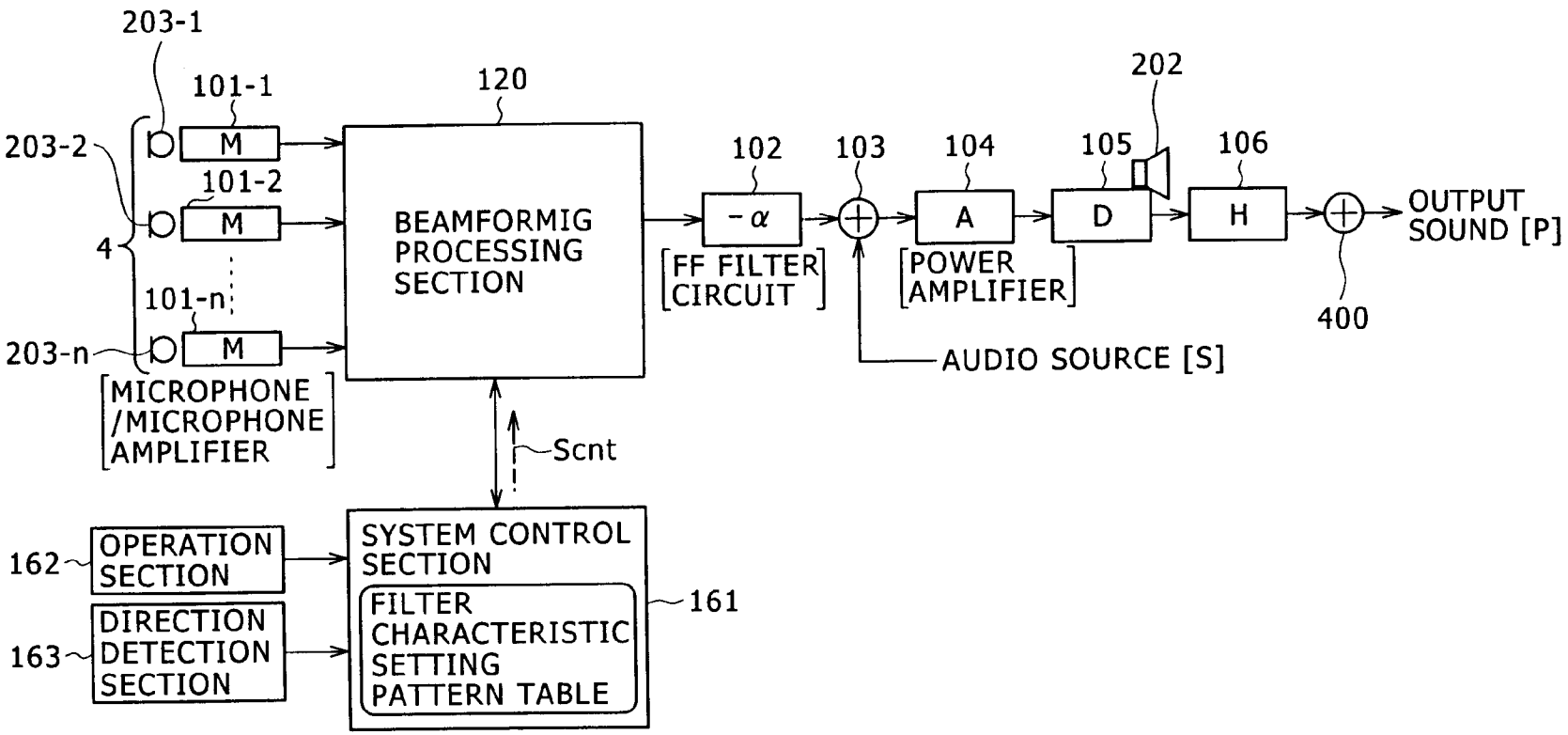
FIG. 11 illustrates an exemplary structure of a noise cancellation system in a headphone device in accordance with another embodiment of the present invention.

FIG. 11 illustrates the exemplary structure in accordance with this other embodiment. Note that, in FIG. 11, components having their counterparts in FIG. 10 are assigned the same reference numerals as those of their counterparts in FIG. 10, and descriptions thereof will be omitted here. Also note that, in FIG. 11, the beamforming processing section 120 is represented as a single block, but the beamforming processing section 120 has a similar internal structure to that in FIG. 10.

A system control section 161 is shown in FIG. 11. The system control section 161 in this case outputs a filter control signal Scnt to change or set the filter characteristics (corresponding to the transfer functions Q1 to Qn and R1 to Rn) of the filter circuits 131-1 to **131-*n* and 141-1 to 141-*n* in the beamforming processing section 120. A filter characteristic setting pattern table 161*a* held in the system control section 161** is referenced to determine what filter characteristic is set in each of the filter circuits.

An operation section 162 in this case is provided at a predetermined location on a body of the headphone device 1, for example. The operation section 162 includes an operation unit for simultaneously or independently changing the direction of the sound source of the external sound to be cancelled and the direction of the sound source of the external sound to be emphasized, and a circuit portion for generating an operation information signal corresponding to an operation performed on the operation unit and outputting the generated operation information signal to the system control section 161.

A direction detection section 163 uses, for example, a sensor such as a gyrocompass to detect at least a direction (an orientation, a gradient, etc.) in which the headphone device 1 faces, with a predetermined location on the body of the headphone device 1 as a base, and outputs a detection signal representative of the detected direction to the system control section 161.

In accordance with this structure, by operating the operation section 162, the user is able to variably set the location of the sound source of the external sound to be cancelled and/or the location of the sound source of the external sound to be emphasized.

When the user has operated the operation section 162, the operation information signal is inputted to the system control section 161, and in response thereto, the system control section 161 reads, from the filter characteristic setting pattern table, data representative of a filter characteristic setting pattern for setting the location of the sound source specified by the inputted operation information signal, and, based on this data, outputs the filter control signal Scnt. In response thereto, the beamforming processing section 120 variably sets the filter characteristics of the internal filter circuits. As a result, the location of the sound source of the external sound to be cancelled and/or the location of the sound source of the external sound to be emphasized are actually changed in accordance with the user operation.

Based on the detection signal outputted from the direction detection section 163, the location of a sound source that is in a previously specified direction and at a previously specified angle of elevation (gradient) is identified for cancellation and/or emphasis of the external sound, regardless of how the user who is wearing the headphone device 1 changes an orientation of his or her head, for example.

For this purpose, the system control section 161 recognizes a current orientation and a current angle of elevation (gradient) of the headphone device 1 based on the detection signal inputted from the direction detection section 163, and calculates differences between the recognized orientation and angle of elevation and the specified orientation and angle of elevation. Then, based on the calculated differences, the location of the sound source of the sound to be cancelled and/or the location of the sound source of the sound to be emphasized are adjusted.

Figure 12:
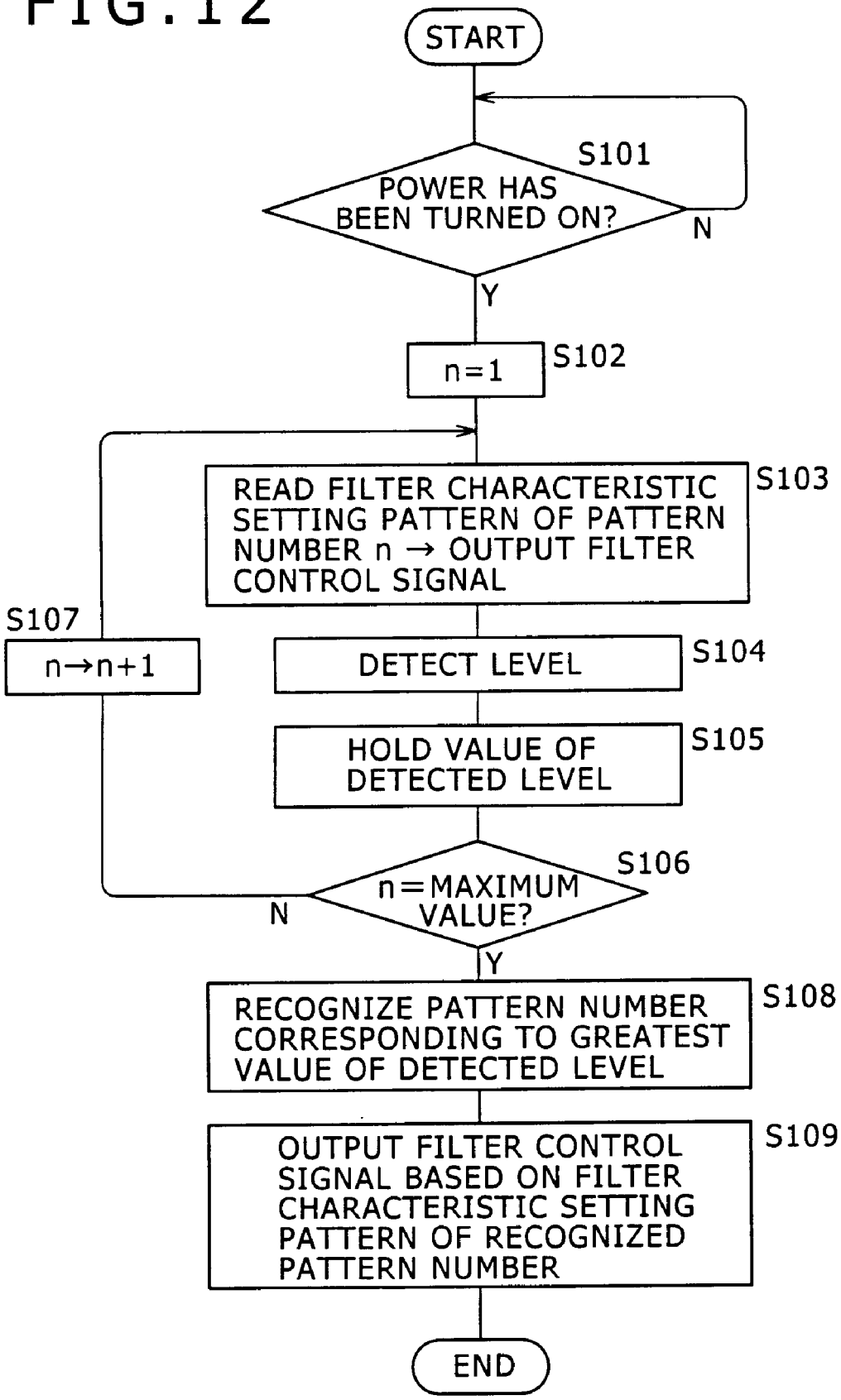
FIG. 12 is a flowchart illustrating a procedure performed by a system control section for setting a location of a sound source of a sound to be cancelled in accordance with levels of ambient noises, in accordance with the other embodiment of the present invention.

In accordance with the structure as illustrated in FIG. 11, the system control section 161 is able to adaptively change at least the location of the sound source of the sound to be cancelled by performing a procedure as illustrated in a flowchart of FIG. 12.

In the procedure of FIG. 12, first, control waits until power of the headphone device 1 is turned on, and when the power of the headphone device 1 has been turned on, control proceeds to a procedure of step S102 and later for setting the location of the sound source of the sound to be cancelled.

At step S102, 1 is assigned to a variable n corresponding to a pattern number in the filter characteristic setting pattern table for initialization.

At step S103, a filter characteristic setting pattern corresponding to a current pattern number n stored in the filter characteristic setting pattern table is read, and the filter control signal Scnt corresponding to the read setting pattern is outputted to the beamforming processing section 120.

In accordance with the filter control signal Scnt thus outputted, the beamforming processing section 120 variably sets the filter characteristics in the filter circuits 131-1 to **131-*n* within the cancellation filter section 130 (or the filter circuits 141-1 to 141-*n* within the emphasis filter section 140). As a result, as the output from the combiner 132 in the cancellation filter section 130**, the audio signal of the sound subjected to beamforming with respect to the location of the certain specific sound source corresponding to the set filter characteristics is obtained.

Then, at step S104, the output from the combiner 132 thus obtained is inputted, and a level thereof is detected. At step S105, a value of the detected level is held.

After the process of step S105, at step S106, it is determined whether the current variable n is a maximum value. If it is determined that the current variable n is not the maximum value, the variable n is incremented by 1 at step S107, and the processes of steps S103 to S106 are repeated.

Here, in the filter characteristic setting pattern table, data representing patterns each concerning the characteristics of the filter circuits for identifying the location of a separate sound source is stored such that each pattern number corresponds to a separate sound source. Therefore, as a result of repeating the processes of steps S103 to S105 for each pattern number, the levels of the sounds that came from the locations of the sound sources set in accordance with the pattern numbers are held as the values of the detected levels. Then, after the processes of steps S103 to S105 are performed for all predetermined pattern numbers, the determination at step S106 becomes affirmative, and control proceeds to step S108.

At step S108, a pattern number corresponding to the greatest of the values of the detected levels held is recognized. The sound emitted at the location of the sound source identified by the filter characteristics corresponding to the pattern number having the greatest value of the detected level is the loudest in the surroundings of the headphone device 1. That is, in the case where sounds emitted around the headphone device 1 are regarded as noise, the loudest noise is emitted at the specific location corresponding to the pattern number having the greatest value of the detected level.

Then, at step S109, a filter control signal Scnt based on a filter characteristic setting pattern stored in the filter characteristic setting pattern table so as to be associated with the pattern number recognized at step S108 is outputted. As a result, the cancellation filter section 130 in the beamforming processing section 120 comes to have a directional characteristic with respect to the location of the sound source for which the greatest value of the detected level was obtained, i.e., the sound source of the loudest noise, so that the sound coming from the location of this sound source will be selectively cancelled.

In short, in the procedure as illustrated in FIG. 12, the locations of the sound sources around the headphone device 1 are identified one by one with a predetermined resolution, the levels of the sounds (noise) emitted from the respective sound sources are detected, and the location of the sound source having the greatest level of noise is identified, so that the sound coming from the location of this sound source will be selectively cancelled. Moreover, since selection of the location of the sound source of the sound to be cancelled is performed when the power of the headphone device 1 has been turned on, an appropriate noise cancellation effect is obtained automatically when the user starts using the headphone device. Note, however, that the selection of the location of the sound source of the sound to be cancelled may be performed at other times than when the power of the headphone device 1 has been turned on. For example, this selection may be started in accordance with a user operation.

In this case, there are some conceivable manners of setting a location of a sound source in the emphasis filter section 140 in accordance with the setting of the location of the sound source in the cancellation filter section 130 at step S109. For example, it is conceivable that a location of a sound source that is in exactly the opposite direction to the location of the sound source set in the cancellation filter section 130 is set in the emphasis filter section 140.

In order for the system control section 161 to perform the procedure illustrated in FIG. 12, the system control section 161 may be provided with a microcomputer, and a CPU in this microcomputer may execute a program corresponding to the procedure of FIG. 12. Such a program may be stored in a ROM or the like within the above microcomputer. Alternatively, the program may be stored in an external storage medium or the like so that the program can be installed or updated as necessary.

Alternatively, the system control section 161 may have provided therein a hardware structure for performing the procedure illustrated in FIG. 12.

In the structures of the above-described embodiments, the beamforming is achieved by the microphone array. The beamforming aims to obtain an audio signal of a sound picked up by the microphones with a certain directional characteristic. Such an audio signal can be obtained without the use of the technique using the microphone array. Hereinafter, other embodiments that do not use the technique using the microphone array will be proposed.

Structures of a sound input device and a microphone device in which two microphones are used to achieve a specific sound pickup directivity have been proposed by the present assignee in Japanese Patent Laid-open No. Hei 5-316587, Japanese Patent Laid-open No. Hei 6-75591, and so on. Such a structure is adopted in an embodiment below.

Figure 13:
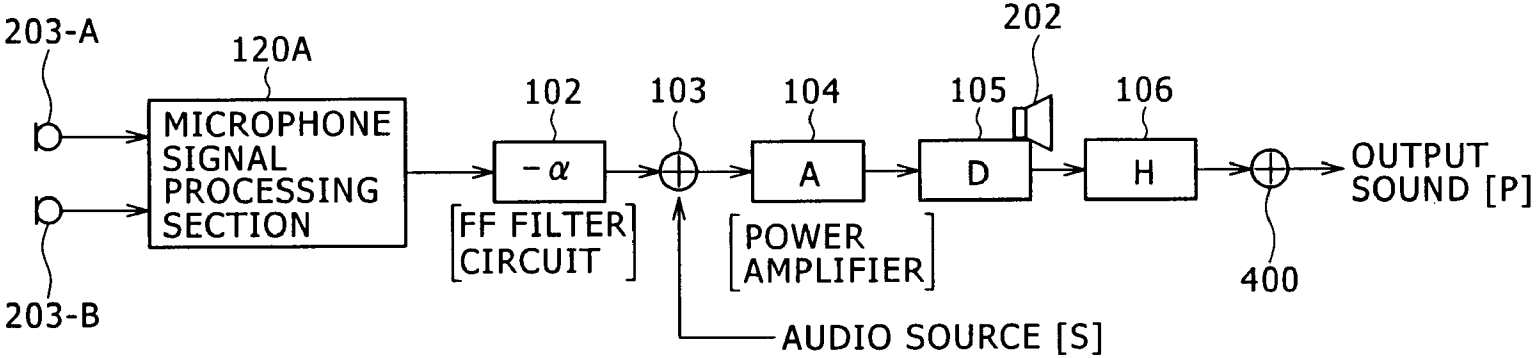
FIG. 13 illustrates an exemplary structure of a noise cancellation system in a headphone device in accordance with yet another embodiment of the present invention.

That is, referring to FIG. 13, in place of the microphone array section 4 as illustrated in FIG. 10, two microphones 203-A and 203-B are provided. These microphones 203-A and 203-B are provided on the exterior of the housing section 201, for example. Relative positions, directivity, and so on of the microphones 203-A and 203-B may follow descriptions in Japanese Patent Laid-open No. Hei 5-316587 and Japanese Patent Laid-open No. Hei 6-75591 mentioned above. Audio signals obtained by sound pickup by these microphones 203-A and 203-B are inputted to a microphone signal processing section 120A. The microphone signal processing section 120A has a structure equivalent to a circuit structure for receiving signals from the microphones and obtaining an output sound signal as described in Japanese Patent Laid-open No. Hei 5-316587 and Japanese Patent Laid-open No. Hei 6-75591 mentioned above. Then, an audio signal outputted from the microphone signal processing section 120A is inputted to the FF filter circuit. FIG. 13 is identical to FIG. 10 in the transfer function block 102 corresponding to the FF filter circuit and the subsequent stages.

In accordance with the above structure, a sound corresponding to a set directivity is selectively cancelled, while a sound coming from a low-sensitivity direction is not cancelled so as to be relatively emphasized.

In another embodiment connected with the structure of FIG. 13, a single microphone is provided for each channel so that a direction of a location of a sound source of a sound that should not be cancelled can be set.

In this embodiment, microphones having directivity for a certain specific direction are attached to the exterior of the housing section 201 of the headphone device 1. Regarding the directivity, the microphones may be either unidirectional or bi-directional. When attaching each of the microphones to the exterior of the housing section 201, the directivity of the microphone is directed in accordance with the direction of the location of the sound source of the sound to be cancelled. Then, an audio signal obtained by sound pickup by the microphone and amplification by a microphone amplifier is inputted to the FF filter circuit 102 and the subsequent components in FIG. 10 or the like. As a result, the sound coming from the direction to which the directivity of the microphone is directed is cancelled while sounds coming from the other directions are not cancelled.

It has been assumed in the foregoing description that the components of the noise cancellation systems as illustrated in FIGS. 10, 11, 13, and so on are all provided on the part of the headphone device 1. However, at least one component other than the microphones 203 for picking up sounds including unwanted sounds (noise) and the driver 202 can be provided on a device separate from the headphone device 1 without contradiction to the concept of the present invention. Examples of such noise cancellation headphone systems include a system composed of a headphone device and an external adapter device including at least one of the components other than the microphone 203 and the driver 202, such as the microphone amplifier, the FB filter circuit, the FF filter circuit, the power amplifier, and so on.

In the case where a noise cancellation system is implemented on a device having a function of reproducing an audio signal of content, such as a portable audio player that outputs, to a headphone terminal, an audio signal (which corresponds to the audio signal S of the audio source) obtained by reproducing audio content, a telephone device, or a network audio communication device, at least one component other than the microphone 203 and the driver 202 may be provided on the part of the device.

In the noise cancellation systems in accordance with the above-described embodiments, the audio signal S of the audio source is assumed to be inputted. However, input of an audio signal of such an audio source is not essential to the present invention. For example, in one embodiment, a noise cancellation system may have only the function of reducing noise that comes from a specific direction or a location of a specific sound source, without accepting the input of such an audio signal. Such a noise cancellation system can be effectively used, for example, for allowing a voice of a person in front to be heard excellently and allowing other ambient sounds to be cancelled in an environment in which the ambient sounds are very great in volume, for example.

When actually constructing circuits in the noise cancellation systems in accordance with the above-described embodiments, either analog or digital circuits can be used. Also, both analog and digital circuits may be used in combination to construct the circuits in the noise cancellation systems.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone device, comprising:

a sound pickup section configured to pick up an external sound;

a directivity setting section configured to generate a directional pickup audio signal, which is an audio signal obtained by picking up the external sound with a desired directional characteristic, based on an audio signal outputted from said sound pickup section;

a loudspeaker;

an audio signal generation section configured to generate a cancellation-use audio signal for attenuating the directional pickup audio signal based on the directional pickup audio signal; and a driving signal generation section configured to generate a driving signal, which is an audio signal for driving said loudspeaker and includes at least the cancellation-use audio signal, wherein said sound pickup section includes a plurality of microphones, and said directivity setting section generates the directional pickup audio signal by compensating delays in arrival of a sound component coming from a location of a specific sound source at the plurality of microphones, with respect to audio signals obtained by sound pickup by the plurality of microphones, and combining the delay-compensated audio signals together, the delays being caused based on locations at which the plurality of microphones are arranged.

2. The headphone device according to claim 1, further comprising:

another sound pickup section including a plurality of other microphones; and another directivity setting section configured to generate another directional pickup audio signal by compensating delays in arrival of another sound component coming from a location of another specific sound source at the plurality of other microphones, with respect to other audio signals obtained by sound pickup by the plurality of other microphones, and combining the delay-compensated other audio signals together, the delays being caused based on locations at which the plurality of other microphones are arranged; wherein said audio signal generation section generates an emphasis-use audio signal for emphasizing the other directional pickup audio signal, along with the cancellation-use audio signal.

3. The headphone device according to claim 1, wherein said sound pickup section includes two microphones each having a predetermined directional characteristic, and said directivity setting section performs signal processing for generating the directional pickup audio signal based on audio signals outputted from the two microphones.

4. The headphone device according to claim 1, wherein said directivity setting section sequentially generates provisional directional pickup audio signals, which are directional pickup audio signals corresponding to different directional characteristics, and determines one of the generated provisional directional pickup audio signals that satisfies a predetermined condition to be a right directional pickup audio signal.

5. The headphone device according to claim 4, wherein said directivity setting section performs a process of determining the right directional pickup audio signal when power of the headphone device is turned on.

* * * * *